US005901724A

United States Patent [19]

Andrea et al.

[11] Patent Number: 5,901,724

[45] Date of Patent: May 11, 1999

[54] ADJUSTABLE CRUTCH WITH SPRING BIASED HANDGRIP

[76] Inventors: Martin Andrea, 2813 R.F.D., Long Grove, Ill. 60047; Christian Andrea, 6921 Compton La. S., Naples, Fla. 33942

[21] Appl. No.: 08/394,067

[22] Filed: Feb. 24, 1995

Related U.S. Application Data

[63] Continuation of application No. 08/174,236, Dec. 28, 1993, abandoned.

[51] Int. Cl.[6] ..... A61H 3/02

[52] U.S. Cl. ..... 135/69; 135/72; 135/82; 482/128

[58] Field of Search ..... 135/68, 69, 72, 135/73; 482/44, 49, 67, 121, 126, 128

[56] References Cited

U.S. PATENT DOCUMENTS

| | | | |
|---|---|---|---|
| 974,494 | 11/1910 | Jensen et al. . | |
| 1,283,387 | 10/1918 | Whalen et al. . | |
| 1,334,208 | 3/1920 | Ames . | |
| 1,358,643 | 11/1920 | Lamming | 135/72 |
| 1,505,081 | 8/1924 | Arndt | 135/68 X |
| 1,635,914 | 11/1927 | Weis . | |
| 2,442,896 | 6/1948 | Joseph . | |
| 2,547,265 | 3/1951 | Hilgeman . | |
| 2,696,826 | 6/1954 | Davies . | |
| 4,476,885 | 10/1984 | Stein | 135/72 X |
| 4,753,259 | 6/1988 | Hansen et al. | 135/68 |
| 4,763,680 | 8/1988 | Acosta, Sr. | 135/68 |
| 4,865,064 | 9/1989 | Parsons et al. | 135/68 |
| 4,865,065 | 9/1989 | Chen | 135/68 X |
| 4,979,533 | 12/1990 | Hansen et al. . | |
| 5,101,846 | 4/1992 | Greatwood | 135/73 |

FOREIGN PATENT DOCUMENTS

| | | | |
|---|---|---|---|
| 38989 | 3/1956 | Poland | 135/68 |

*Primary Examiner*—Lanna Mai
*Attorney, Agent, or Firm*—Fitch, Even, Tabin & Flannery

[57] ABSTRACT

The present invention relates to an orthopedic crutch that includes a pair of vertical supports which may be formed from tubular members, connected together at one end by a cross-member, which may be cushioned, forming an armpit support. The other ends of the vertical supports are bent inwardly and connected to an adjustable support leg assembly. A handgrip assembly is disposed intermediate the opposing ends of the vertical supports. The handgrip assembly includes a horizontal cross-member, rigidly secured between the vertical supports, a pair of telescoping members and a yoke assembly. One telescoping member, formed as an extending tubular member, is rigidly secured intermediate the opposing ends of the horizontal cross-member. The other telescoping member, which includes a tubular portion, formed with a slightly larger diameter to enable telescoping action between the two telescoping members, is rigidly secured to the yoke assembly which includes two depending legs. A coil spring is disposed within the telescoping members which act as a spring retainer to bias the yoke upwardly. A handgrip, which may be cushioned, is rigidly secured between the two depending legs of the yoke. By providing a movably mounted and spring biased handgrip relative to the vertical supports, the orthopedic crutch in accordance with the present invention, provides increased comfort level to the user. The depending legs of the yoke may be formed with longitudinal arcuate notches which act to guide the vertical movement of the yoke relative to the vertical supports. Additionally, the support leg assembly, armpit support, as well as the handgrip assembly, are relatively easily and quickly adjustable.

12 Claims, 10 Drawing Sheets

ADJUSTABLE CRUTCH WITH SPRING BIASED HANDGRIP

This application is a continuation, of application Ser. No. 08/174,236 filed Dec. 28, 1993 now abandoned.

BACKGROUND OF THE INVENTION

1. Field of the Invention

The present invention relates to an orthopedic crutch and, more particularly, to an adjustable orthopedic crutch with a handgrip, movably mounted in a vertical direction which includes spring biasing to provide dynamic support to the user and improve the comfort level to the user.

2. Description of the Prior Art

Various orthopedic crutches are known in the art. Examples of such orthopedic crutches are disclosed in U.S. Pat. Nos. 974,494; 1,283,387; 1,334,208; 1,635,914; 2,442,896; 2,547,265; 2,696,826; 4,476,885; and 4,979,533. In particular, U.S. Pat. Nos. 1,635,914; 2,442,896 and 2,547,265 disclose an orthopedic crutch which includes a rigidly mounted handgrip support and a spring mounted armpit support. With such a configuration as weight is shifted to the crutch, the armpit support moves downwardly. As weight is shifted from the crutch, the armpit support moves upwardly under the influence of a biasing spring. U.S. Pat. No. 1,334,208 discloses a similar arrangement except that the handgrip support is connected to an upper vertical support which results in the armpit support, as well as the handgrip support, being movably mounted relative to the lower vertical support. U.S. Pat. Nos. 4,476,885 and 4,979,533 relate to orthopedic crutches with adjustment mechanisms.

None of the patents mentioned above disclose an orthopedic crutch in which the handgrip support is movably mounted relative to the armpit supports to provide dynamic support to the user. As such, the comfort level of such orthopedic crutches is relatively limited.

SUMMARY OF THE INVENTION

It is an object of the present invention to provide an improved orthopedic crutch.

It is yet another object of the present invention to provide an orthopedic crutch which provides increased comfort level to the user.

It is yet a further object of the present invention to provide an improved orthopedic crutch which includes a handgrip support that is movably mounted relative to the armpit support to provide dynamic support to the user.

Briefly, the present invention relates to an orthopedic crutch that includes a pair of vertical supports which may be formed from tubular members, connected together at one end by a cross-member, which may be cushioned, forming an armpit support. The other ends of the vertical supports are bent inwardly and connected to an adjustable support leg assembly. A handgrip assembly is disposed intermediate the opposing ends of the vertical supports. The handgrip assembly includes a horizontal cross-member, rigidly secured between the vertical supports, a pair of telescoping members and a yoke assembly. One telescoping member, formed as an extending tubular member, is rigidly secured intermediate the opposing ends of the horizontal cross-member. The other telescoping member, which includes a tubular portion, formed with a slightly larger diameter to enable telescoping action between the two telescoping members, is rigidly secured to the yoke assembly which includes two depending legs. A coil spring is disposed within the telescoping members which act as a spring retainer to bias the yoke upwardly. A handgrip, which may be cushioned, is rigidly secured between the two depending legs of the yoke. By providing a movably mounted and spring biased handgrip relative to the vertical supports, the orthopedic crutch in accordance with the present invention, provides increased comfort level to the user. The depending legs of the yoke may be formed with longitudinal arcuate notches which act to guide the vertical movement of the yoke relative to the vertical supports. Additionally, the support leg assembly, armpit support, as well as the handgrip assembly, are relatively easily and quickly adjustable.

DESCRIPTION OF THE INVENTION

These and other objects of the present invention will be readily apparent upon consideration of the following specification and attached drawings wherein.

DETAILED DESCRIPTION OF THE PREFERRED EMBODIMENT

Figure 1:
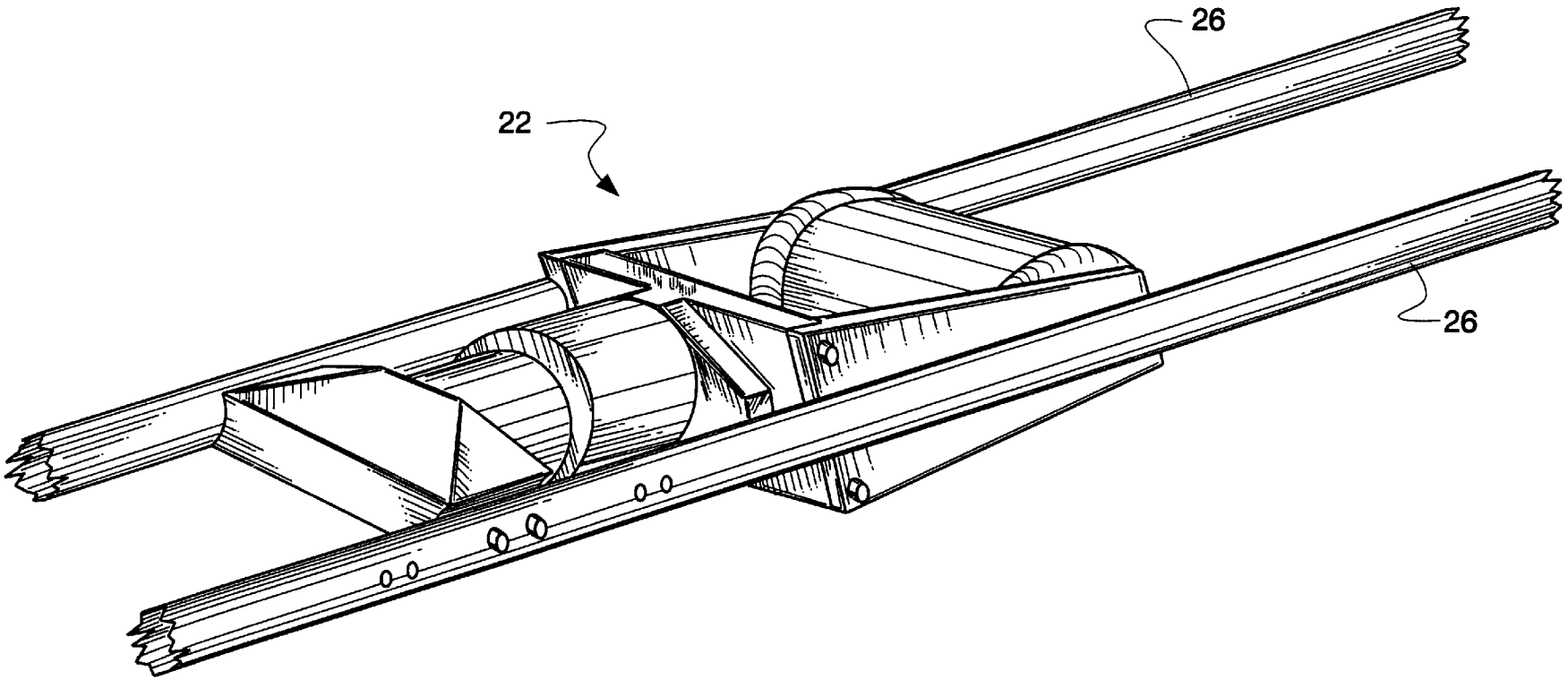
FIG. 1 is a partial perspective view of the orthopedic crutch in accordance with the present invention, illustrating the handgrip assembly in an at rest position.

The orthopedic crutch, in accordance with the present invention, is generally identified with the reference numeral 15. The orthopedic crutch 15 includes a support leg assembly 16, an armpit support 17 or, alternatively, an adjustable armpit assembly 18, a handgrip assembly 22 which includes spring biased handgrip 24 and a pair of vertical supports 26. An important aspect of the invention is the handgrip assembly 22 which enables the handgrip 24 to be spring biased in an upward direction By providing a movably mounted and spring biased handgrip 24, the comfort level to the user is greatly improved. In addition, the orthopedic crutch 15, in accordance with the present invention, the support leg assembly 16, handgrip assembly 22 and the armpit assembly 18 enable the crutch 15 to be rather quickly and easily adjusted to accommodate user's of different heights.

Figure 3:
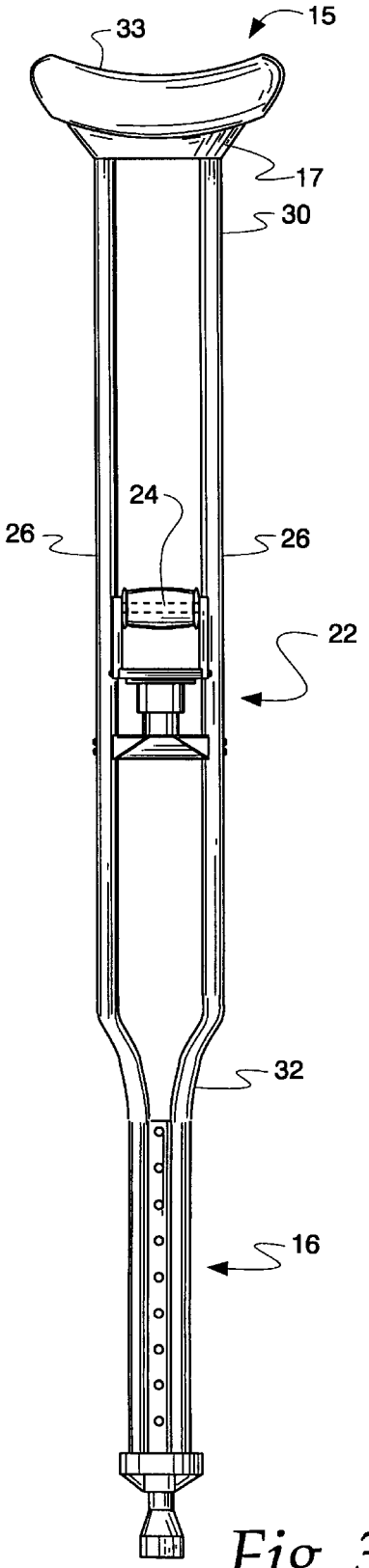
FIG. 3 is a front elevational view of the orthopedic crutch in accordance with the present invention.

With reference to the drawings and, in particular, FIG. 3, the orthopedic crutch 15, in accordance with the present invention, includes a pair of vertical supports 26. Each of the vertical supports 26 may be formed from elongated, hollow tubular members. The supports 26 are bent to form an upper support portion 30 and a lower support portion 32 such that the upper support portions 30 of the vertical supports 26 are generally parallel and spaced apart a relatively wider distance than the lower support portions 32. In particular, the lower support portions 32 are spaced apart by an appropriate distance to enable a support leg assembly 16 to be sandwiched therebetween, as will be discussed in more detail below.

The upper support portions 30 of the vertical supports 26 are rigidly connected together at an end by a cross-member 17 which forms an armpit support. The cross-member 17 may be covered with a foam rubber cushion 33 to provide additional comfort to the user. Unlike the crutches disclosed in the patents discussed above, the horizontal cross-member 17 forming the armpit support is rigidly secured to the upper support portions 30 of the vertical supports 26. In particular, the cross-member 17 may be formed as a molded plastic member, formed as an arcuate segment as shown in FIG. 3 with a plurality of integrally formed tube retaining portions 34 (FIG. (14). The diameter of the tube retaining portions 34 is selected to be slightly larger than the diameter of the vertical supports 26 to provide a friction fit for the vertical supports 26.

Figure 4:
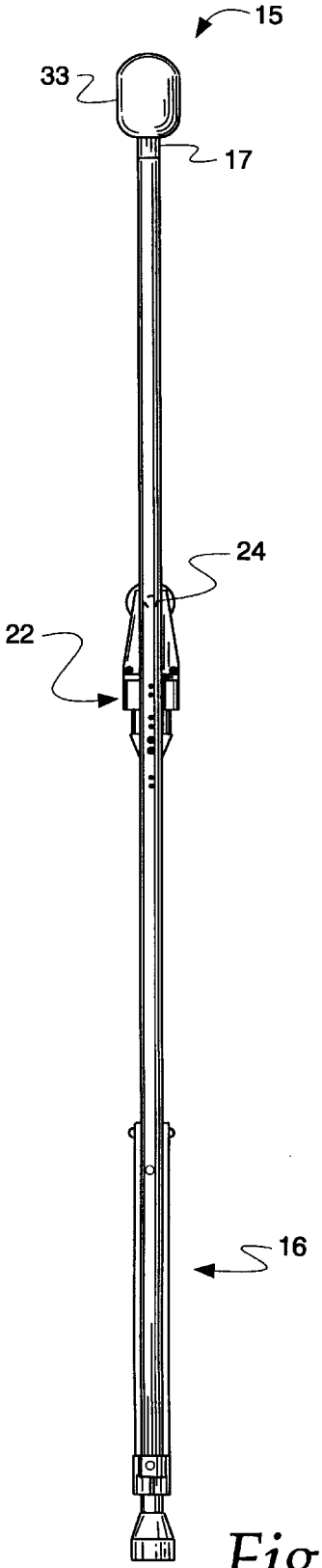
FIG. 4 is a side elevational view of the orthopedic crutch in accordance with the present invention.
Figure 5:
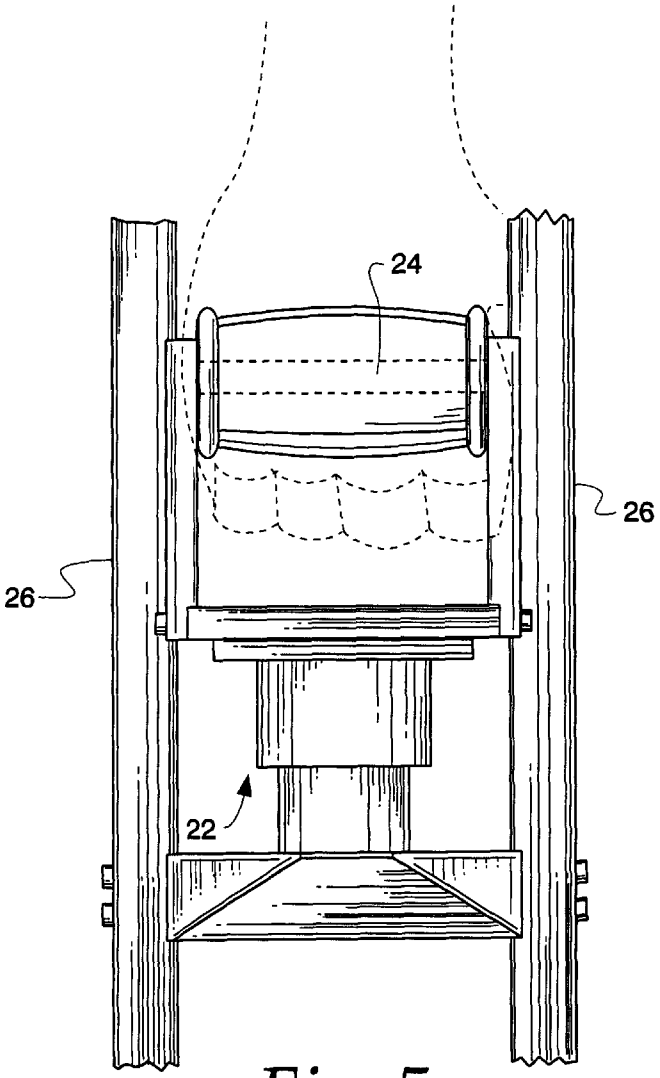
FIG. 5 is a partial front view of the orthopedic crutch illustrating the handgrip assembly in accordance with the present invention in a static or at rest position.
Figure 8:
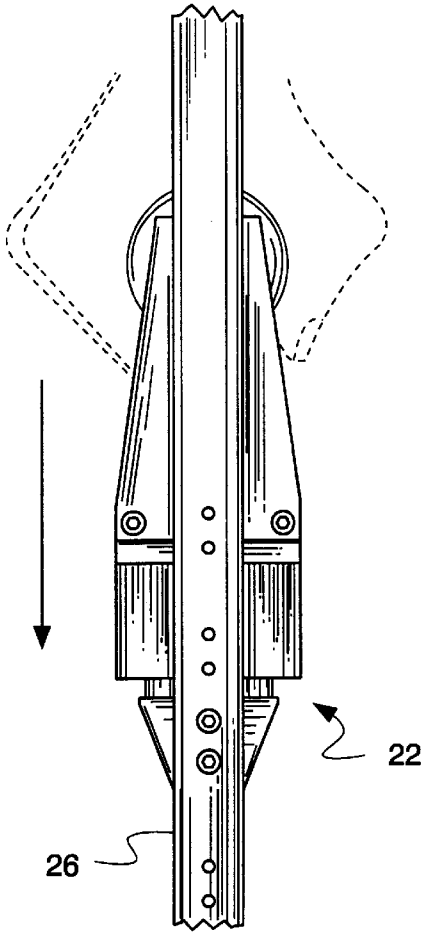
FIG. 8 is similar to FIG. 7 but illustrating the handgrip assembly in accordance with the present invention in an operative position.
Figure 7:
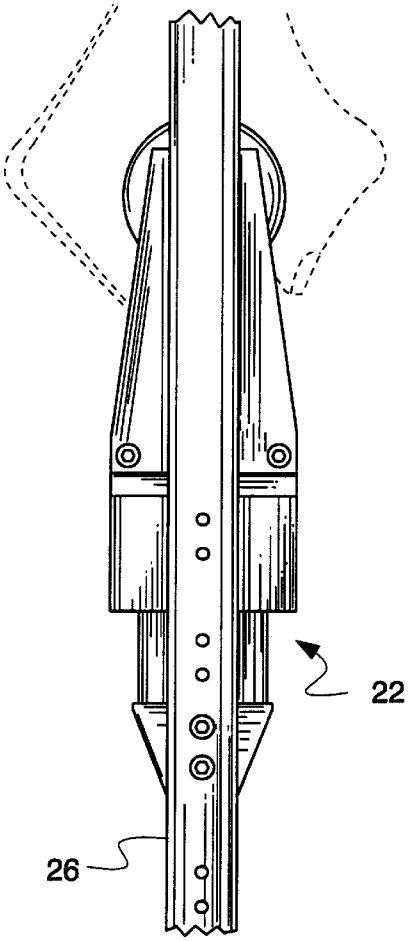
FIG. 7 is a partial side elevational view of the orthopedic crutch illustrating the handgrip assembly in accordance with the present invention in a static position.

An important aspect of the invention is the handgrip assembly 22 which enables the handgrip 24 to be supported to enable movement in a vertical direction, as shown in FIGS. 4 and 5. The amount of travel of the handgrip assembly 22 and, consequently, the handgrip 24 is selected to provide optimal comfort to the user, for example, ¾ inches. In operation, as weight is shifted to the crutches 15, the handgrip 24 moves downwardly against a biasing force to provide dynamic support to the user at the handgrip 24. As the user shifts his weight away from the crutches 15, the handgrip 24 is biased upwardly.

Figure 2:
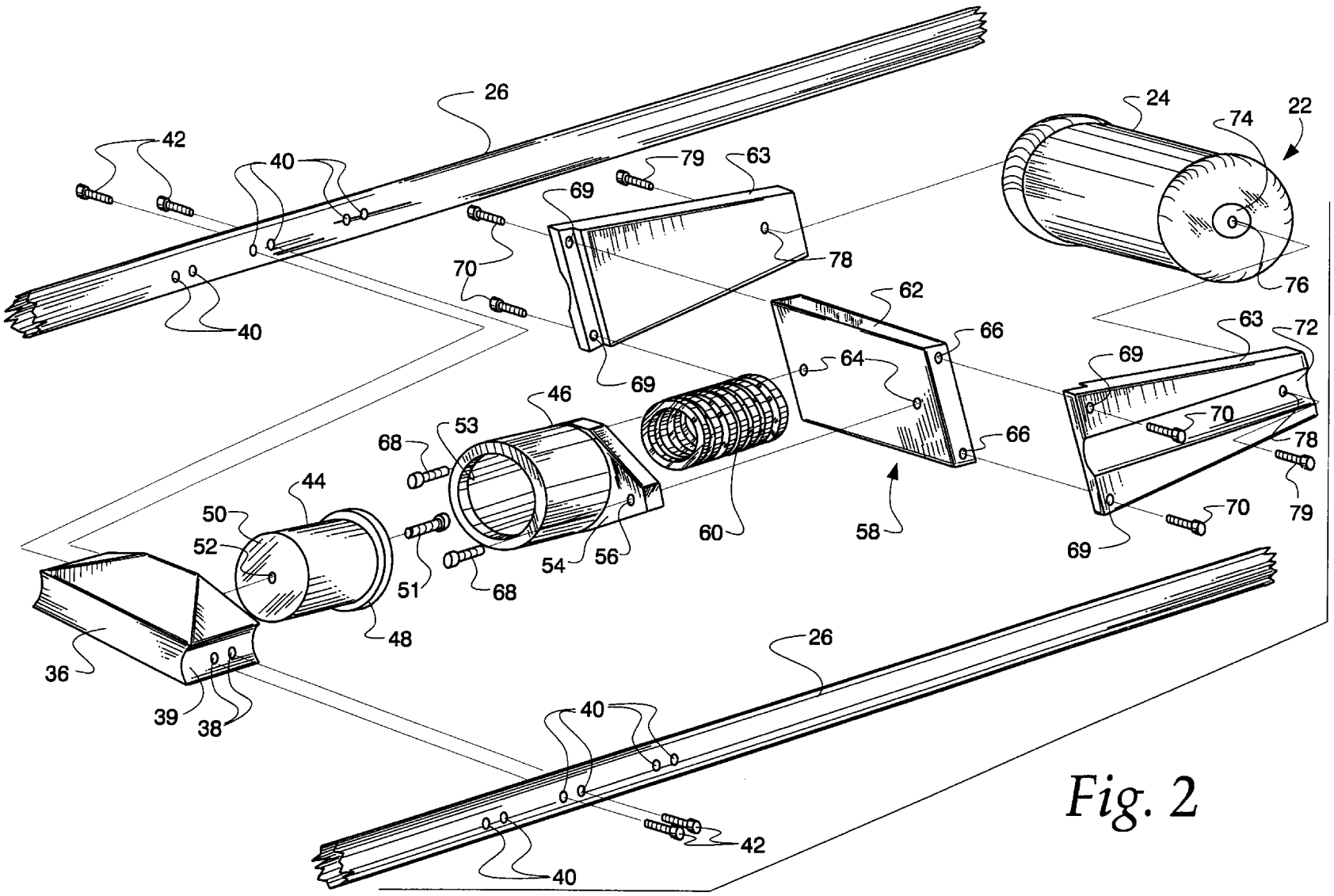
FIG. 2 is an exploded partial perspective view of the portion of the orthopedic crutch illustrated in FIG. 1.
Figure 9:
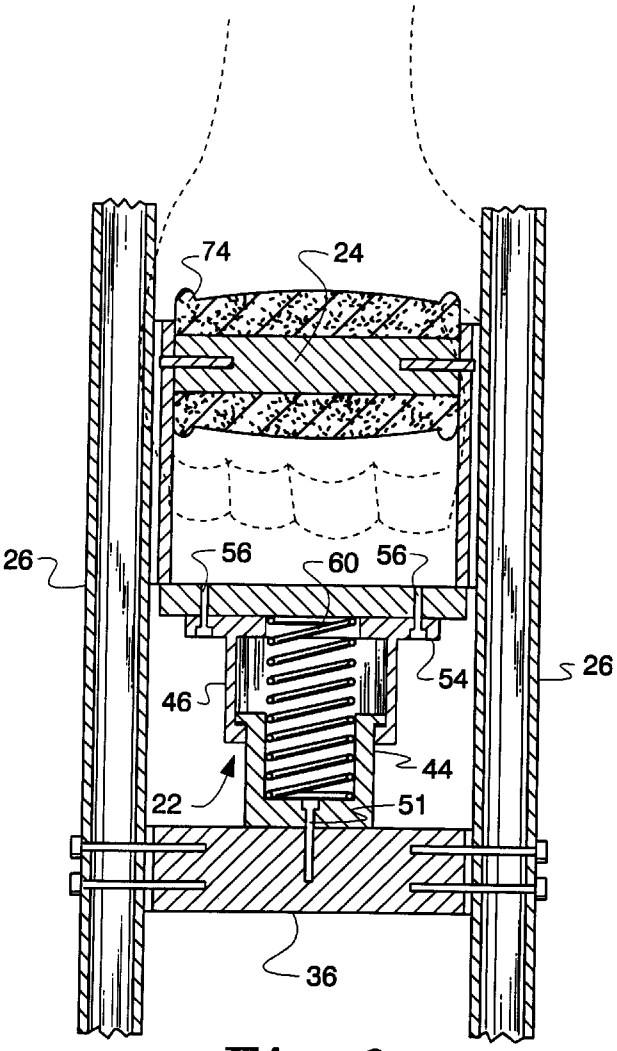
FIG. 9 is a partial sectional elevational view of the orthopedic crutch in accordance with the present invention.

As illustrated in FIGS. 2 and 9, the handgrip assembly 22 includes a cross-member 36, rigidly secured to the upper support portions 30 of the vertical supports 26. In particular, the cross-member 36 may be formed as a generally rectangular member having a length approximately equal to the distance between the upper support portions 30 of the vertical supports 26 and formed from a solid material, such as aluminum. Arcuate notches 39 may be formed on the opposing edges of the cross-member 36. A plurality of threaded apertures 38 are disposed along an axis generally parallel to horizontal axis of the cross-member 36. These threaded apertures 38 are aligned with transverse apertures 40 in the upper support portions 30 of the vertical supports 26 to receive suitable threaded fasteners 42 to rigidly secure the cross-member 36 to the upper support portions 30 of the vertical supports 26. With such an arrangement, the longitudinal axis of the cross-member 36 is generally perpendicular to the longitudinal axis of the upper support portions 30 of the vertical supports 26.

As shown in FIG. 2, a plurality of sets of apertures 40 may be provided in the upper support portions 30 of the vertical supports 26 to enable the height of the handgrip assembly 22 to be rather easily and quickly adjusted. For example, the pairs of apertures 40 in each of the vertical supports may be spaced apart by 1¼ inch increments to enable the crutch 15 to be adjusted over a relatively wide range to accommodate users of different heights.

The handgrip assembly 22 also includes first and second telescoping members 44 and 46, respectively. These telescoping members 44 and 46 cooperate with one another to enable the handgrip 24 to be supported for vertical movement. In particular, the first telescoping member 44 may be formed as a generally hollow cylindrical member with an outwardly extending ring portion 48 on one end and defining a base portion 50 at an opposing end. An aperture 52 is centrally disposed in the base portion 50, as best shown in FIG. 9, to enable the first telescoping member 44 to be secured to the cross-member 36 with a suitable fastener 51. The diameter of the first telescoping member 44 is selected to enable it to be slidably received relative to the second telescoping member 46.

The second telescoping member 46 is formed as a generally hollow cylindrical member having an inwardly facing ring portion 53 (FIG. 9) formed on one end and a flange portion 54 formed on an opposing end. The ring portions 48 and 53 formed on the first end second telescoping members 44 and 46, respectively, are configured to limit vertical movement of the second telescoping member 46 as shown best in FIG. 9. The flange portion 54 is provided with a plurality of unthreaded apertures 56 to enable the second telescoping member 46 to be rigidly secured to a yoke assembly 58 as will be discussed in more detail below.

Figure 6:
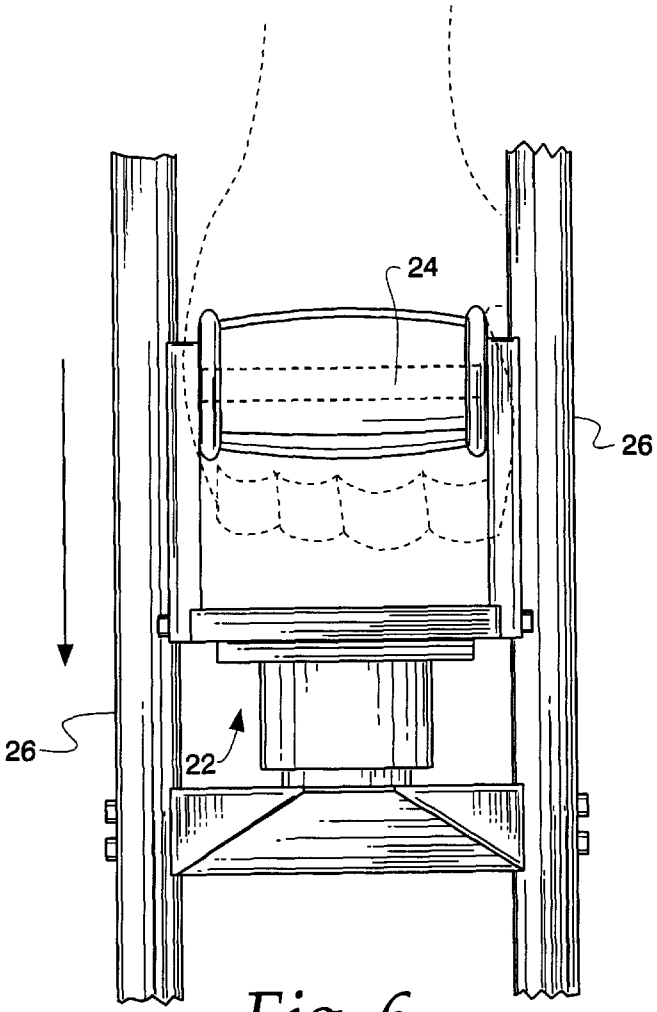
FIG. 6 is similar to FIG. 5 but illustrating the handgrip assembly in accordance with the present invention in an operative position.

As shown best in FIG. 9, a biasing spring 60 is disposed within the telescoping members 44 and 46 to provide a biasing force between the base portion 50 of the first telescoping member 44 and the yoke assembly 58. The spring 60 biases the yoke assembly 58 upwardly to the position illustrated in FIG. 5 in a stator or at rest position. As weight is shifted to the yoke assembly 58, as shown in FIG. 6, the spring 60 is compressed to provide dynamic support and, thus, improved comfort to the user.

The characteristics of the spring 60 are selected to provide optimum comfort to the user. For example, a helical constant compression spring may be selected with a spring constant of 82 lbs./inch. If the telescoping members 44 and 46 are configured for a maximum travel of about ¾ inches, the maximum biasing force will be a little over 60 lbs.

The yoke assembly 58 includes a generally rectangular cross-member 62 a pair of depending legs 63. The cross-member 62 is formed from a solid material, which includes a plurality of threaded transverse apertures 64 and a plurality of threaded apertures 66 disposed on opposing edges generally horizontal to a longitudinal axis of the cross-member 62. The apertures 64 are adapted to be aligned with the apertures 56 in the flange portion 54 of the second telescoping member 46 to enable the second telescoping member 46 to be rigidly secured thereto with suitable threaded fasteners 68. The apertures 66 enable the depending legs 63 to be secured to the cross-member 62. In particular, the apertures 66 are adapted to be aligned with apertures formed in the depending legs 63 to enable the depending legs 63 to be secured to the cross-member 62 with suitable threaded fasteners 70.

Figure 10:
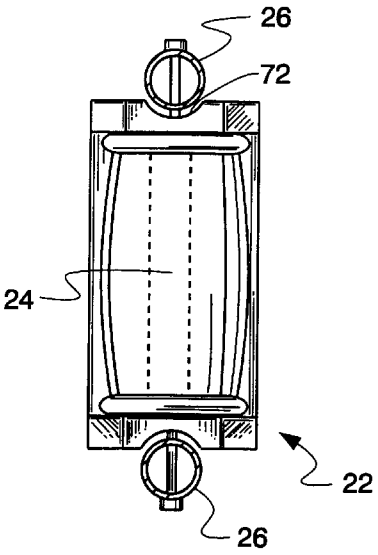
FIG. 10 is a top view of the orthopedic crutch in accordance with the present invention.

The yoke assembly 58 is configured to move vertically between the vertical supports 26. In particular, the depending legs 63 are formed as irregular shaped members with an arcuate longitudinally notch 72, as shown in FIGS. 2 and 10. This notch 72 acts as a guide relative to the tubular vertical supports 26.

The yoke assembly 58 also includes a handgrip 24 rigidly secured between the depending legs 63. The handgrip 24 may be formed as a rigid cylindrical member, as shown, and covered with a foam rubber cushion 74 for improved user comfort. The handgrip 24 may include centrally disposed threaded apertures 76 on opposing ends to enable the handgrip 24 to enable the handgrip 24 to be rigidly secured to the depending legs 63. In particular, the apertures 76 are adapted to be aligned with corresponding apertures 78, formed in the depending legs 63 for receiving suitable threaded fasteners 79.

Figure 11:
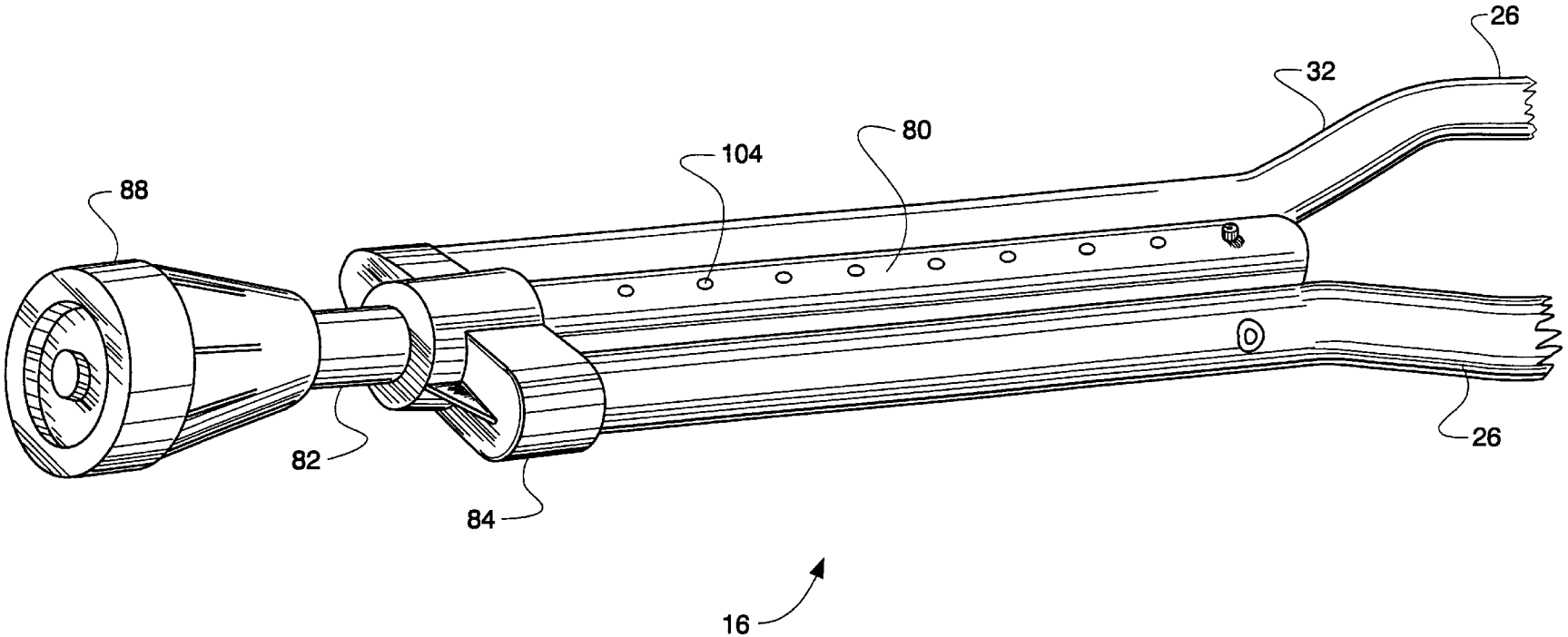
FIG. 11 is a partial perspective view of a support leg assembly in accordance with the present invention shown in a fully retracted position.
Figure 12:
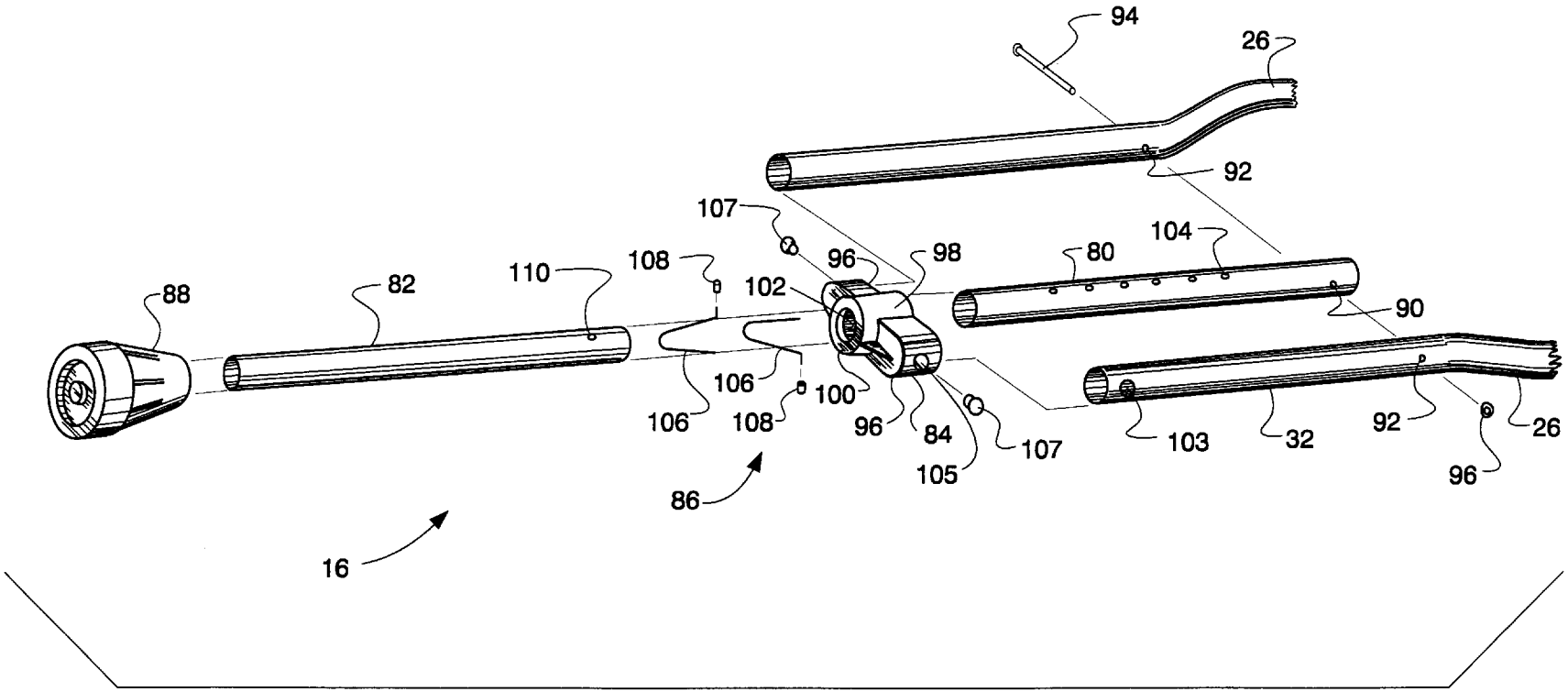
FIG. 12 is an exploded perspective view of the support leg assembly illustrated in FIG. 11.

The support leg assembly 16 is best illustrated in FIGS. 11 and 12. As shown, the support leg assembly is disposed adjacent to the lower support portions 32 of the vertical supports 26 and includes a pair of telescoping supports 80 and 82, a molded tube retainer and guide 84, a spring assembly 86 and a molded rubber foot 88. The support 80 is adapted to be rigidly secured between the lower support portions 32 of the vertical supports 26. In particular, an aperture 90 is disposed one end of the support 80. This aperture 90 is adapted to be aligned with apertures 92 formed in the vertical supports 26 to enable the support 80 to be rigidly secured to the vertical supports 26 on one end with a suitable threaded fasteners 94 and nut 96.

The other end of the support 80 is received in the tube retainer and guide 84. In particular, the tube retainer and guide 84 includes pair of tube retaining portions 96 for receiving the ends of the vertical supports 26. A guide portion 98 is disposed between the tube retaining portions 96 which acts to carry one end of the support 80 and also acts as a guide for the other support 82. The guide portion 98 includes a base portion 100 with a centrally disposed aperture 102. The base portion 100 forms a seat for one end of the support 80 while the aperture 102 forms a guide for the support 82 to enable telescoping action between the supports 80 and 82. Apertures 103 formed on one end of the vertical supports 26 are aligned with apertures 105 formed in the tube retaining portions 96 to enable the vertical supports 26 to be rigidly secured to the tube retainer and guide 84 with suitable fasteners 107.

The support leg assembly 16 is rather easily and quickly adjustable. In particular, the support 80 is formed with a plurality of apertures 104 which cooperate with the spring assembly 86 to enable the distance that the support leg 82 extends outwardly relative to the tube retainer and guide 84. In particular, the spring assembly 86 includes a pair of generally U-shaped springs 106 with a spring constant, for example, of 27 lbs./inch, and extending buttons 108. The springs 106 are disposed within the support 82. Aligned apertures 110 formed on one end of the support 82 are adapted to receive the buttons 108. The springs 106 bias the buttons 108 outwardly. The apertures 104 formed in the support 80 are adapted to receive the buttons 108 to enable the support 82 to be locked in place relative to the support 80. In order to adjust the height of the support leg assembly 16, the buttons 108 are simply squeezed together until the support 82 can be moved either upwardly or downwardly relative to the support 80. As the support 82 is moved relative to the support 82, the springs 106 bias the buttons 108 outwardly causing the buttons 108 to lock in the next pair of apertures 104 on the support 80.

Figure 13:
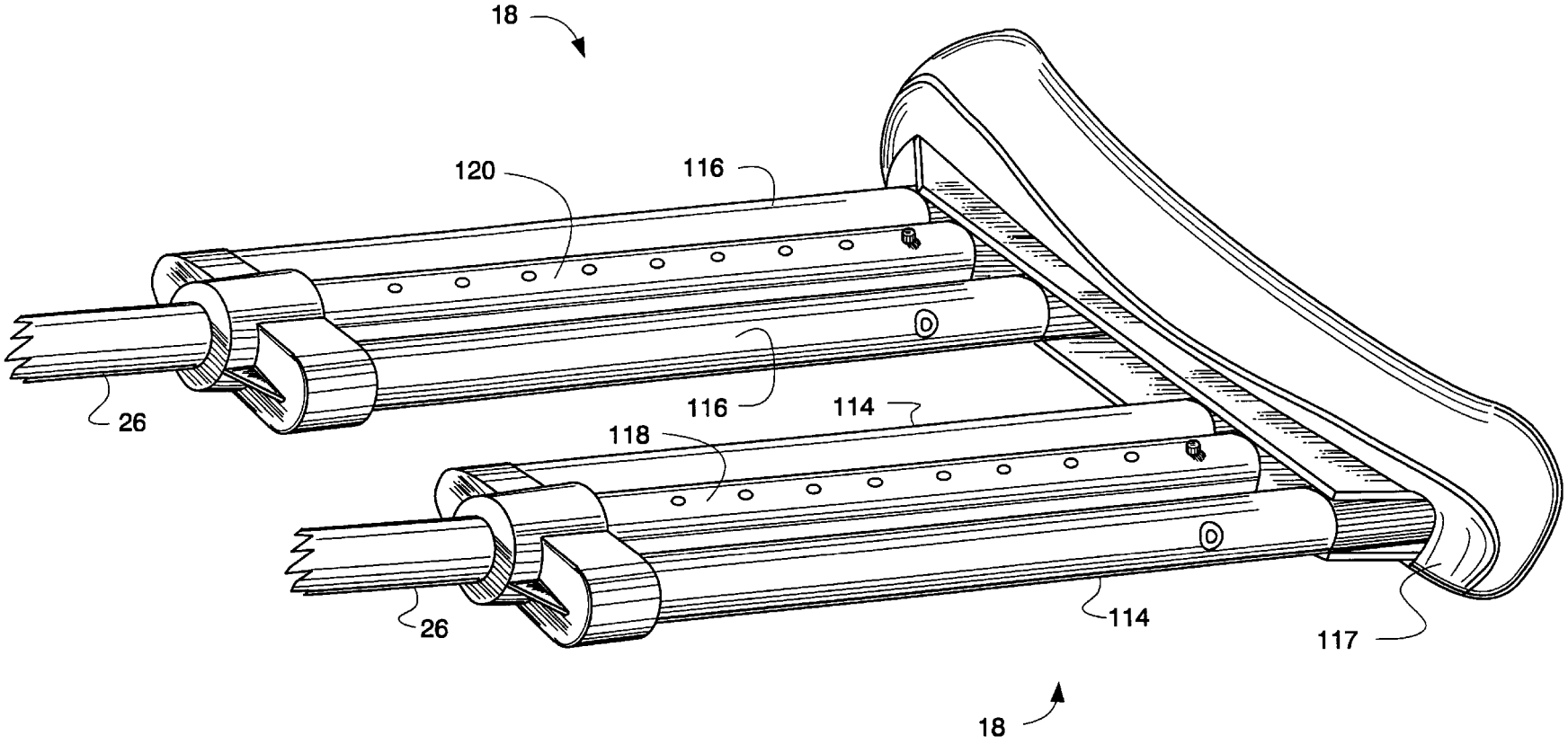
FIG. 13 is a partial perspective view of an alternative embodiment of an orthopedic crutch with an adjustable armpit support assembly in accordance with the present invention.
Figure 14:
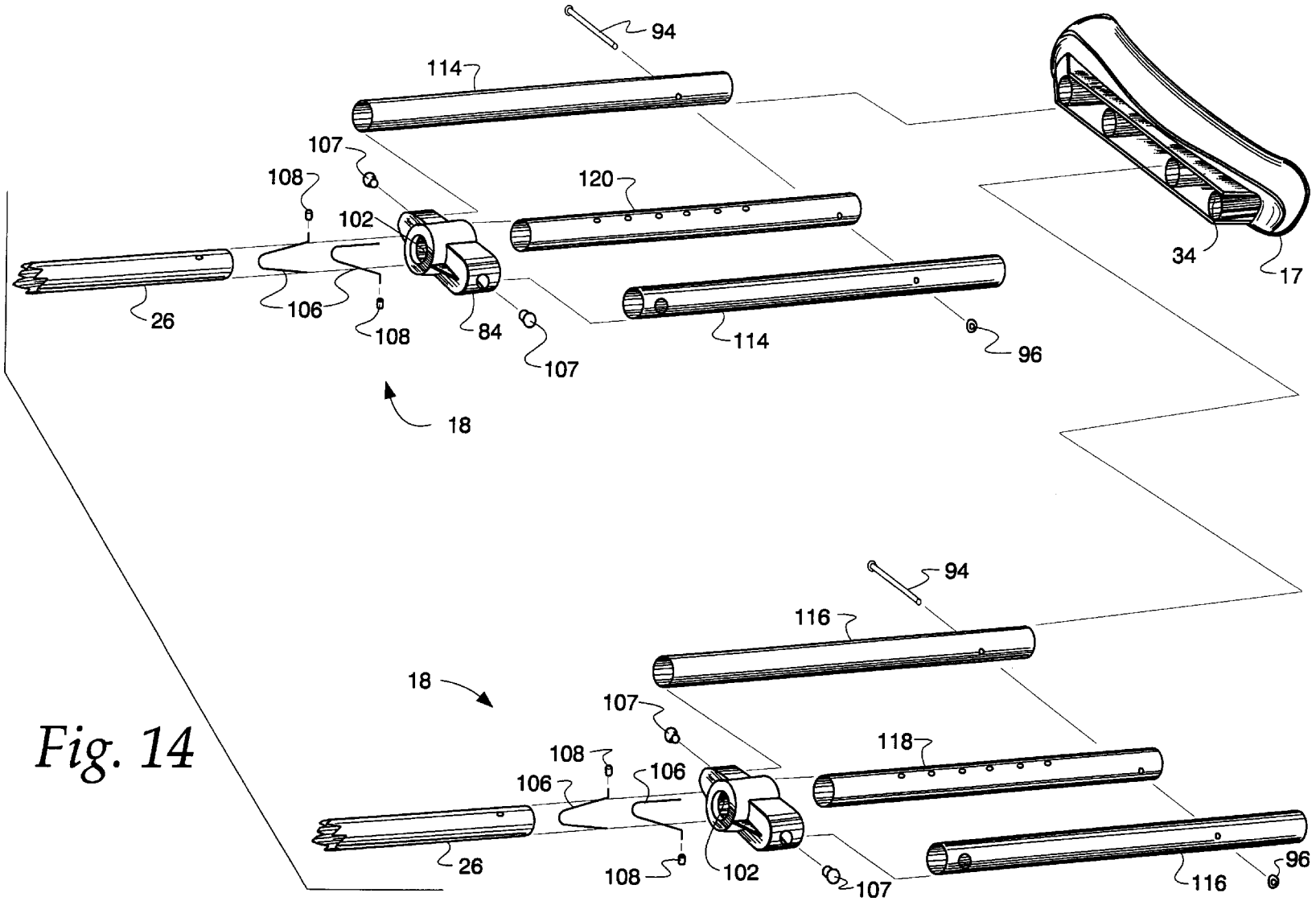
FIG. 14 is an exploded perspective view of the armpit support assembly illustrated in FIG. 13.

An alternative embodiment of the invention is shown in FIGS. 13 and 14. In this embodiment, two armpit support assemblies 18 are illustrated for enabling adjustment of the armpit support 17. These support assemblies 18 are virtually the same as the support leg assembly 16 with like parts identified with the same reference numerals. In this embodiment, the support 17 is configured to receive two pairs of auxiliary vertical supports 114 and 116 and a pair of adjustment legs 118 and 120. The balance of the assemblies 112 are virtually identical to the support leg assembly 16 to enable rather quick and easy adjustment of the crutch 15 to accommodate user's of different heights.

Obviously, many modifications and variations of the present invention are possible in light of the above teachings. Thus, it is to be understood that, within the scope of the appended claims, the invention may be practiced otherwise than as specifically described above.

What is claimed and desired to be secured by a Letters Patent of the United States:

1. An orthopedic crutch comprising:

a pair of vertical supports;

an upper cross-member, rigidly connected to said vertical supports at an upper end forming an armpit support;

a vertical support leg, rigidly connected relative to a lower end of said pair of said vertical supports, opposite said upper end;

a handgrip;

means for movably supporting said handgrip relative to said vertical support leg and said armpit support to enable said handgrip to move in a vertical direction generally parallel to said vertical supports while said orthopedic crutch is in use; and means for biasing said supporting means to provide a dynamic support for said handgrip while said orthopedic crutches is in use.

2. An orthopedic crutch as recited in claim 1 wherein said biasing means includes a spring.

3. An orthopedic crutch as recited in claim 2 wherein said spring is a coil spring.

4. An orthopedic crutch as recited in claim 1, wherein said supporting means includes a horizontal support, rigidly secured between said vertical supports;

a yoke assembly which includes a pair of spaced apart depending legs; and means for dynamically supporting said yoke assembly while said orthopedic crutch is in use to enable both upward and downward vertical movement of said yoke assembly relative to said horizontal support between said vertical supports.

5. An orthopedic crutch as recited in claim 4 further including means for adjusting the vertical position of said horizontal support.

6. An orthopedic crutch as recited in claim 1 further including means for adjusting the vertical position of said support leg.

7. An orthopedic crutch comprising:

a pair of vertical support, an upper cross-member, rigidly connected to said vertical support at an upper end forming an armpit support;

a support leg, connect intermediate the opposing end of said support;

a handgrip;

means for movably support said handgrip to enable said handgrip to move in a vertical direction generally parallel to said vertical support;

means for biasing said support means, wherein said supporting means includes a horizontal support rigidly secured between said vertical supports; a yoke assembly which includes a pair of spaced apart depending legs; and means for supporting said yoke assembly to enable vertical movement of said yoke assembly relative to said horizontal support between said vertical supports; and wherein members, said first telescoping member rigidly secured tom said horizontal support and said second telescoping member rigidly secured to said yoke assembly.

8. An orthopedic crutch as recited in claim 7 further including means for limiting travel of said second telescoping member.

9. An orthopedic crutch comprising:

a pair of vertical supports;

an upper cross-member rigidly connected to said vertical supports at an upper end forming an armpit support;

a support leg connected intermediate the opposing end of said support;

a handgrip;

means for movably supporting said handgrip to enable said handgrip to move in a vertical direction generally parallel to said vertical supports;

means for biasing said supporting means;

wherein said supporting means includes a horizontal support, rigidly secured between said vertical supports; a yoke assembly which includes a pair of spaced apart depending legs; and means for supporting said yoke assembly to enable vertical movement of said yoke assembly relative to said horizontal support between said vertical supports; and wherein said supporting means further includes first and second telescoping members, said first telescoping member rigidly secured to said horizontal support and said second telescoping member rigidly secured to said yoke assembly; and means for limiting travel of said second telescoping member; wherein said limiting means includes an outwardly extending ring formed on said first telescoping member and an inwardly extending ring formed on said second telescoping member.

10. An orthopedic crutch comprising:

a pair of vertical supports;

an upper cross-member, rigidly connected to said vertical supports at an upper end forming an armpit support;

a vertical support leg, rigidly connected to a lower end of said pair of said vertical supports, opposite said upper end;

a handgrip;

means for movable supporting said handgrip relative to said vertical support leg and said armpit support to enable said handgrip to move in a vertical direction generally parallel to said vertical supports while said orthopedic crutch is in use; and means for biasing said supporting means to provide a dynamic support for said handgrip while said orthopedic crutch is in use; and means for cushioning said handgrip.

11. An orthopedic crutch comprising:

a pair of vertical supports;

an upper cross-member, rigidly connected to said vertical supports in an upper end forming an armpit support;

a vertical support leg, rigidly connected to a lower end of said pair of said vertical supports, opposite upper end;

a handgrip;

means for movably supporting said handgrip relative to said vertical support leg and said armpit support to enable said handgrip to move in a vertical direction generally parallel to said vertical supports while said orthopedic crutch is in use;

means for biasing said supporting means to provide a dynamic support for said handgrip while said orthopedic crutch is in use; and means for cushioning said armpit support.

12. An orthopedic crutch comprising:

a pair of vertical supports;

an upper cross-member, rigidly connected to said vertical supports at an upper end forming an armpit support;

a support leg, rigidly connected, intermediate the opposing end of said support;

a handgrip; and means for dynamically supporting said handgrip while said orthopedic crutch is in use to provide a movable support for both upward and downward movement of said handgrip.

* * * * *